US005325539A

United States Patent [19]

Kronenberger

[11] Patent Number: 5,325,539

[45] Date of Patent: Jul. 5, 1994

[54] HEADWEAR PIECE WITH COVER FOR SIZE ADJUSTMENT ACTUATOR

[75] Inventor: Robert A. Kronenberger, Deerfield, Ill.

[73] Assignee: American Needle, Buffalo Grove, Ill.

[21] Appl. No.: 938,843

[22] Filed: Aug. 28, 1992

Related U.S. Application Data

[63] Continuation-in-part of Ser. No. 931,879, Aug. 18, 1992, Pat. No. 5,315,715, and a continuation-in-part of Ser. No. 926,505, Aug. 7, 1992.

[51] Int. Cl.[5] ..... A42B 1/22

[52] U.S. Cl. ..... 2/195.2; 2/183; 2/DIG. 3; 2/DIG. 10

[58] Field of Search ..... 2/181, 181.4, 182.1, 2/182.2, 183, 184, 195, 196, 197, 199, 209.1, 267, 413, 417, 418, DIG. 3, DIG. 10, DIG. 11; 36/29, 71, 88, 93, 114; 128/DIG. 20; 450/38

[56] References Cited

U.S. PATENT DOCUMENTS

| | | | |
|---|---|---|---|
| 5,031,246 | 7/1991 | Kronenberger | 2/183 |
| 5,113,599 | 5/1992 | Cohen | 36/71 |
| 5,153,943 | 10/1992 | Clement | 2/199 |
| 5,155,866 | 10/1992 | Walker | 2/DIG. 3 |
| 5,161,259 | 11/1992 | Shorts | 2/199 |

*Primary Examiner*—Clifford D. Crowder
*Assistant Examiner*—Diana L. Biefeld
*Attorney, Agent, or Firm*—Wood, Phillips, VanSanten, Hoffman & Ertel

[57] ABSTRACT

A headwear piece having a crown defining a first opening for reception of the head of a wearer, an inflatable bladder mounted to the crown so that the bladder resides between the crown and a wearer's head in the crown opening, structure for selectively introducing a fluid into the bladder, and structure mounted to the crown for covering the fluid introducing structure and allowing operation thereof from a location externally of the crown.

25 Claims, 3 Drawing Sheets

HEADWEAR PIECE WITH COVER FOR SIZE ADJUSTMENT ACTUATOR

CROSS-REFERENCE

This is a continuation-in-part of co-pending Ser. No. 07/931,879, filed Aug. 18, 1992, now U.S. Pat. No. 5,315,715, entitled "Headwear Piece With Deformable Cushion Layer" and Ser. No. 926,505, filed Aug. 7, 1992, entitled "Size Adjustable Headwear".

BACKGROUND OF THE INVENTION

1. Field of the Invention

This invention relates to headwear of the type having size adjustment structure and, more particularly, to a cover for an actuator for the size adjustment structure that permits the actuator to be operated from externally of the crown.

2. Background Art

The inventor herein has made a number of significant improvements to conventional headwear. One such improvement is disclosed in U.S. Pat. No. 5,031,246 (the '246 patent).

The invention in the '246 patent is directed to a headwear piece with a bladder on the crown that provides a deformable cushion layer between the crown and the wearer's head. The bladder and at least a portion of the crown are deformable to conform to the wearer's head. In one aspect of the invention in the '246 patent, the bladder can be selectively inflated and deflated to alter the effective diameter of the head-receiving opening on the headwear piece.

A fluid, and preferably air, is directed into the bladder and exhausted therefrom with the headwear piece in place on a wearer's head. A bulb-type actuator can be repeatedly depressed to introduce consecutive charges of air into the bladder until the bladder is filled with the desired amount of fluid. A relief valve allows the fluid to exhaust from the bladder to effect collapse thereof.

One difficulty that has arisen is the problem of incorporating the actuator and relief valve into a flexible crown portion, as on a baseball-style cap, to allow operation of the actuator and relief valve from externally of the crown. There are three principal, and in certain respects competing, objectives that designers contend with in integrating the actuator and relief valve into the crown. First of all, the actuator and relief valve must be readily accessible to the wearer of the headwear piece. Secondly, the actuator and relief valve must be durably mounted to withstand wear due to repeated operation thereof. Thirdly, the actuator and relief valve should not significantly detract from the overall aesthetics of the headwear piece. Designers attempt to achieve these objectives while maintaining manufacturing costs at a minimum.

SUMMARY OF THE INVENTION

The present invention is specifically directed to an improvement in the basic structure disclosed in the '246 patent.

More specifically, the present invention is directed to a headwear piece having a crown defining a first opening for reception of the head of a wearer, an inflatable bladder mounted to the crown so that the bladder resides between the crown and a wearer's head in the crown opening, structure for selectively introducing a fluid into the bladder, and structure mounted to the crown for covering the fluid introducing structure and allowing operation thereof from a location externally of the crown.

Preferably, the covering structure is a flexible membrane made of plastic or rubber.

In one form, the membrane has a preformed receptacle for the fluid introducing structure. The membrane may be at least partially cup-shaped to bound an appropriate receptacle.

To connect the membrane to the crown, and particularly a flexible crown, an opening is provided through the crown in alignment with the structure for introducing fluid to the bladder. A rim on the membrane defines a shoulder which abuts an inside surface of the crown. A bead can be provided to captively engage an edge of the crown bounding the second opening in conjunction with the rim. The rim and bead are suitably secured, as by stitching that extends through the bead, crown and rim. While the bead and rim need not be continuous, preferably the bead and rim extend continuously around, and conform to the shape of, the edge of the crown bounding the second opening.

In one form, the bead has an undercut through which the stitching is directed.

The membrane can also be configured to accommodate a valve for exhausting fluid from the bladder. A port can be provided in the membrane to allow exhaustion of fluid from the bladder to externally of the crown.

The invention further contemplates a headwear piece having a crown defining a first opening for reception of the head of a wearer, structure for selectively altering the size of the first opening, and structure connected to the crown for covering the size altering structure.

The covering structure is, in one form, a membrane with a cup-shaped portion that extends through an opening in the crown to externally of the crown for facilitated operation of the size altering structure.

In one form, that portion of the crown through which the membrane extends is made from flexible material, such as fabric. One suitable headwear piece, into which the present invention can be incorporated, is a baseball-style cap.

DETAILED DESCRIPTION OF THE DRAWINGS

Figure 1:
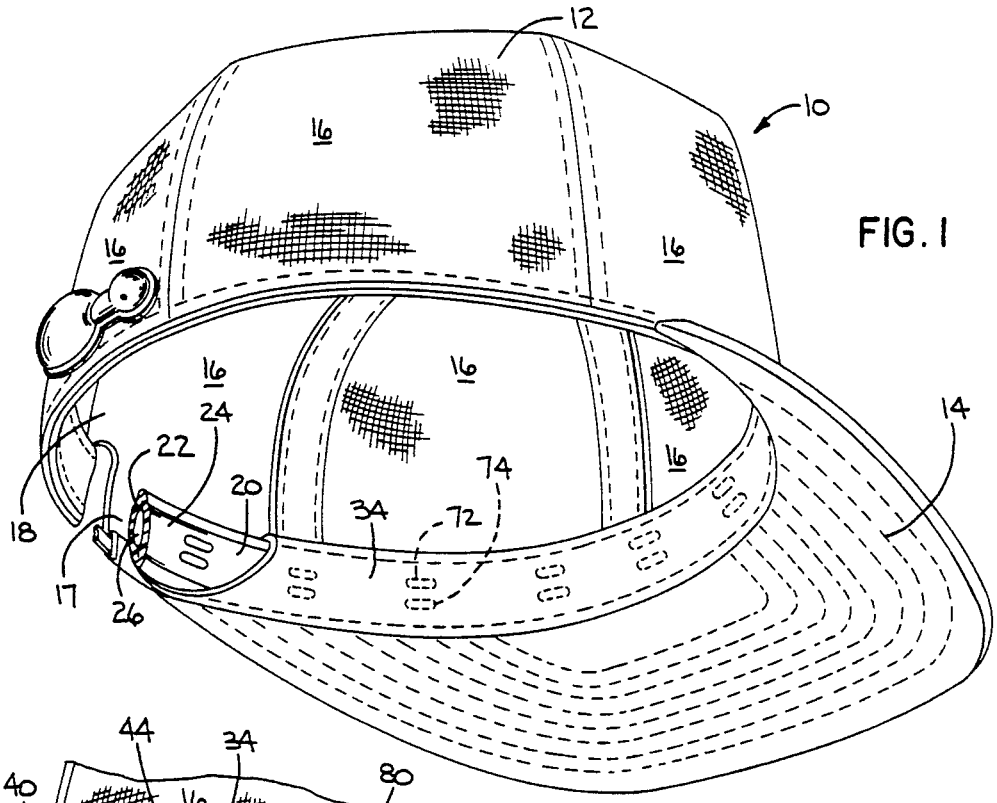
FIG. 1 is a bottom perspective view of a baseball-style cap having a bladder defining a deformable cushion layer on a crown defining an opening for a wearer's head.
Figure 2:
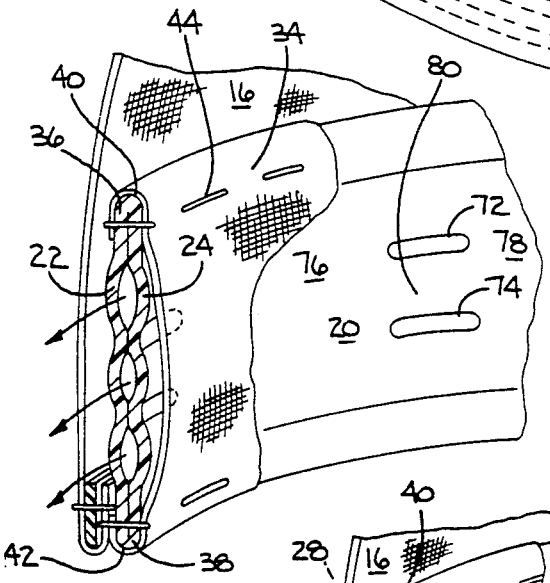
FIG. 2 is an enlarged, fragmentary perspective view of a portion of the bladder showing the pattern of fluid flow through a restricted portion thereof.
Figure 3:
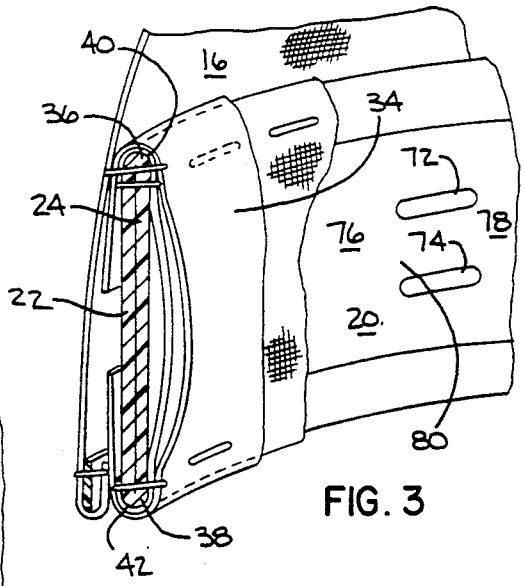
FIG. 3 is an enlarged, fragmentary perspective view of the bladder showing connection of the bladder to the crown of the cap at both top and bottom edges thereof.

An exemplary headwear piece is shown at 10 that is suitable for incorporation of the present invention. The headwear piece 10 is a baseball-style cap, however, it should be recognized that the invention is useable in virtually all different types of headwear having a crown to embrace a wearer's head. For example, the headwear piece could be a visor, a hat, etc.

The cap 10 has an inverted, cup-shaped crown 12 to which a bill/visor 14 is affixed to project forwardly therefrom. The crown 12 is defined by six fabric gores 16 sewn together along adjacent, abutting edges. The lower edge 17 of the crown 12 bounds an opening 18 to accommodate a wearer's head.

A bladder 20 is attached to the crown 12 and defines a deformable cushion layer between the crown edge 17 and the head of a wearer. The advantages afforded by the bladder 20 are described more fully in U.S. Pat. No. 5,031,246, which is incorporated herein by reference.

Figure 4:
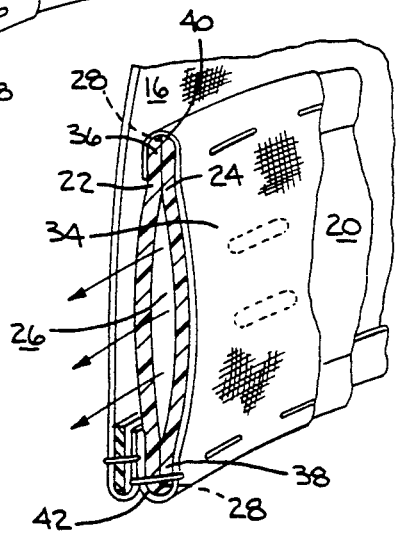
FIG. 4 is an enlarged, fragmentary, perspective view of the portion of the bladder showing the pattern of fluid flow through an unrestricted portion of the bladder.
Figure 5:
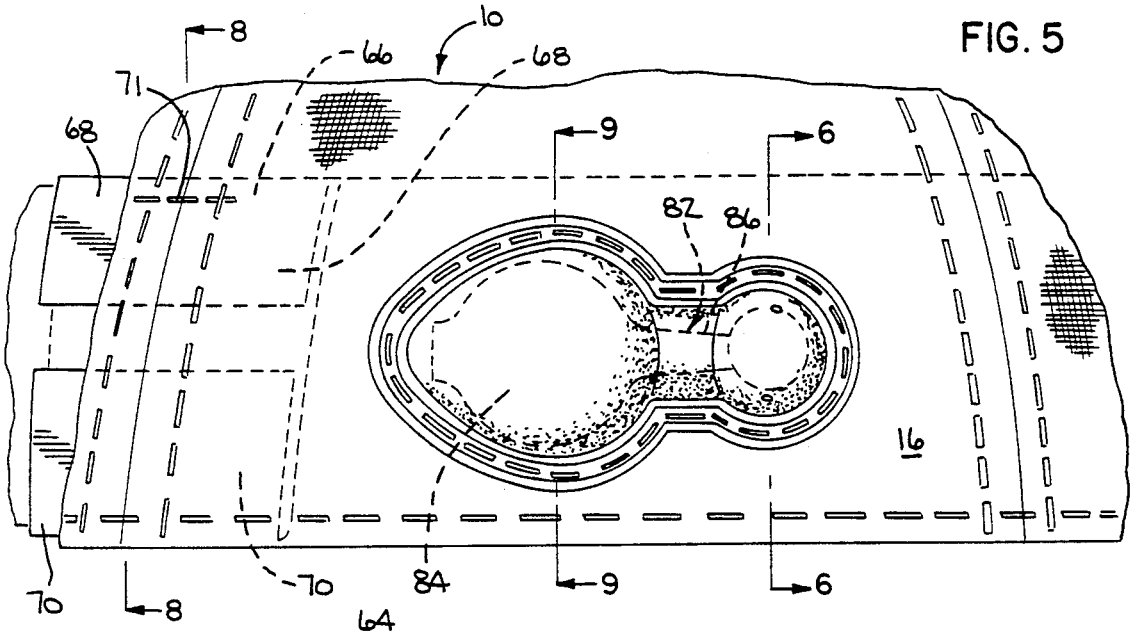
FIG. 5 is an enlarged, fragmentary, rear elevation view of the cap and showing a cover, according to the present invention, over a structure for directing a displaceable fluid into, and allowing exhausting of the displaceable fluid from, the bladder.
Figure 8:
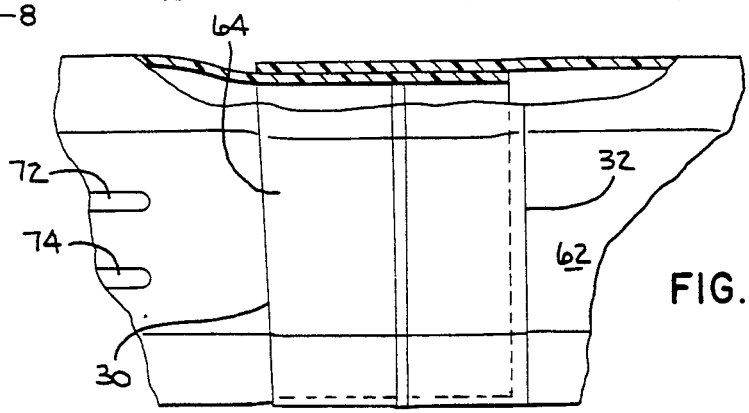
FIG. 8 is an enlarged, fragmentary front elevation view of the connection of the ends of the bladder.
Figure 6:
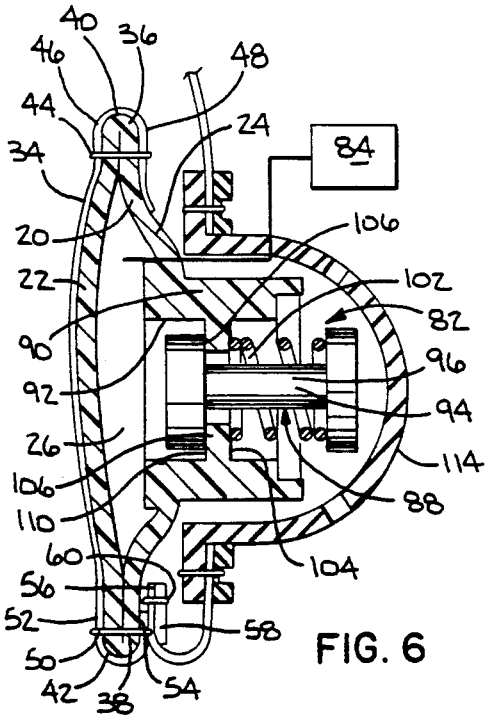
FIG. 6 is a cross-sectional view of a structure for exhausting a displaceable fluid from the bladder and taken along line 6—6 of FIG. 5, with the exhausting structure in its normal state.

The bladder 20 extends through at least 270° around the crown opening 18 and, in a preferred form, extends through substantially 360° to define a continuous structure to embrace the head of a wearer. The assembled bladder 20 has first and second layers 22, 24 which cooperatively bound an airtight space 26 for a displaceable fluid which, in a preferred form, is air. The bladder 20 is shown to be one piece in solid lines in all of the figures. Alternatively, the first and second layers could be defined by separate sheets facially engaged and joined where indicated by dotted lines 28 in FIG. 4. While the bladder 20 can be continuously formed as an endless loop, in a preferred form, the bladder is formed as a tubular strip and is heat sealed at its ends along two lines 30, 32 to define a sealed compartment to confine air, or another working fluid, within the space 26.

Before connecting the bladder 20 to the crown 12, a sweatband 34, made of a moisture absorbent cloth, is partially assembled to the bladder 20. To facilitate connection of the sweatband 34 to the bladder 20 and the preassembled bladder 20 and sweatband 34 to the crown 12, the bladder layers 22, 24 are heat sealed together to define fused beads 36, 38, respectively at the top edge 40 and bottom edge 42 of the bladder 20. The beads 36, 38 provide a mounting portion to allow the bladder 20 to be stitched therethrough without compromising the seal around the air confining space 26.

The sweatband 34 is wrapped around the top edge 40 of the bladder 20 prior to assembly of the bladder 20 to the crown 12. Stitching 44 extends continuously around the bladder 20 and passes through the bead 36 at the top edge 40 and first and second surrounding sweatband layers 46, 48. This produces a first subassembly which can be attached as a unit to the crown 12.

The bladder 20, with the sweatband 34 partially assembled thereto, is then connected to the crown 12. The sweatband 34 is wrapped around the bottom edge 42 of the bladder 20 prior to assembly. The bottom edge 42 of the bladder is connected to the crown 12 by stitching 50 extending entirely around the circumference of the crown. This stitching 50 extends through the fused bead 38, two sweatband layers 52, 54 and an underturned flap 56 on the crown 12. A reinforcing strip 58 is connected to the flap 56 by stitching 60.

The free ends 62, 64 of the sweatband 34 are overlapped at the rear of the cap 10. A rectangular, cloth, splice element 66 is wrapped around both the top edge 40 and bottom edge 42 of the bladder 20, with the sweatband 34 thereon, to define flaps 68, 70. The bottom flap 70 is sandwiched between the sweatband layer 54 and the crown flap 56 and held in place by the stitching 50 in the same operation that connects the bead 38 to the crown 12.

Once the stitching 50 is completed, the flap 68 is folded around the overlapping sweatband ends 62, 64. A line of stitching 71 is then formed through the sweatband ends 62, 64, two layers of the splicing element 66, and the crown 12. Resultingly, the top edge 40 of the bladder 20 is fixed against the crown 12 at the rear of the cap 10, preferably through only a small circumferential range that is less than 90°. The remainder of the top bladder edge 40 is not attached to the crown 12 so that the bladder 20 and sweatband 34 can be folded downwardly out of the crown opening 18.

One aspect of the present invention is the provision of structure to facilitate forming of the bladder 20 to match the curvature of the crown edge 17. To accomplish this, the first and second bladder layers 22, 24 are connected to each other at regularly spaced intervals around the circumference of the bladder 20. More specifically, the first and second layers 22, 24 are bonded by an adhesive, and more preferably, are fused by heat. Other structure that provides a localized restriction in the bladder 20 is also contemplated by the invention.

The heat fusing, in one form, is effected by fusing the first and second layers 22, 24 along two vertically spaced, horizontally extending lines 72, 74. The fuse lines 72, 74 divide the bladder 20 into a plurality of adjoining chambers 76, 78 with their being a restricted passageway 80 between chambers 76, 78. The fuse lines 72, 74 prevent the bladder 20 from expanding fully outwardly thereat. Accordingly, the bladder 20, at the chambers 76, 78, expands more fully than that portion of the bladder 20 in vertical alignment with the fuse lines 72, 74. The result of this is that the bladder 20 tends to hinge at the fuse lines 72, 74. This allows the bladder to bend readily to follow the contour of the crown 12 rather than bridging a large portion of the crown 12, as would occur in the absence of the inventive structure. In a preferred form, the fuse lines 72, 74 are provided at approximately 1-½ inch intervals around the circumference of the bladder 20.

While the bladder 20 may be fully enclosed so as to contain only a predetermined amount of displaceable fluid, it is also a desirable feature to change the amount of fluid in the bladder 20 to alter the effective size of the crown opening 18. For this purpose, means are provided at 82 for introducing a displaceable fluid into, and allowing exhausting of the fluid from, the bladder 20 to thereby alter the effective size of the crown opening 20.

The fluid is directed into the bladder 20 by an enlarged bulb 84. The bulb 84 has a conduit 86 which is in communication with the bladder space 26. By repeatedly depressing the bulb 84, consecutive charges of air are directed into the bladder space 26. The construction of a suitable bulb 84 with a one-way pumping mechanism is known to those skilled in the art.

To exhaust the fluid from the bladder 20, a relief valve is provided at 88. The relief valve 88 has a cylindrical mounting base 90 attached to the bladder 20. The mounting base 90 has a stepped through bore 92 for an actuating button 94. The actuating button 94 has a stem 96 connecting between a blocking head 98 and enlarged actuating head 100. A coil spring 102 surrounds the stem 96 and acts between a shoulder 104 defined by an annular bead 106 on the mounting base 90 and the head 94. The spring 102 normally urges a sealing face 108 on the blocking head 98 facially against a shoulder 110 on the bead 106 to thereby prevent passage of fluid from the space 26 to externally of the bladder 20.

Figure 7:
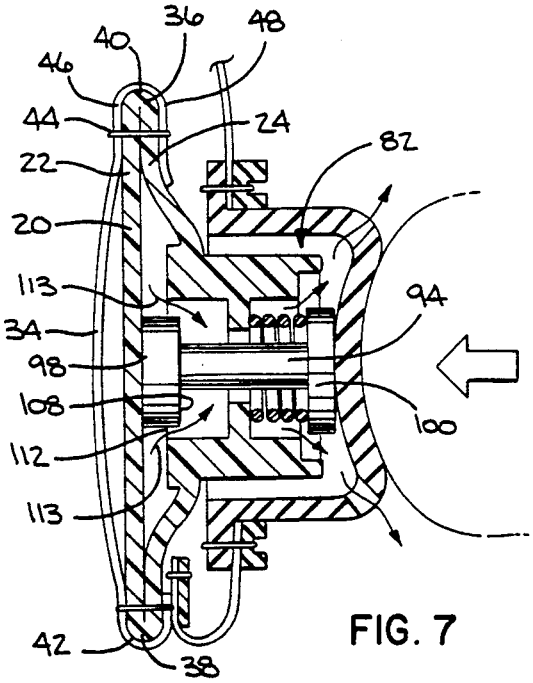
FIG. 7 is a view as in FIG. 6 with the exhausting structure actuated to exhaust fluid from the bladder.
Figure 9:
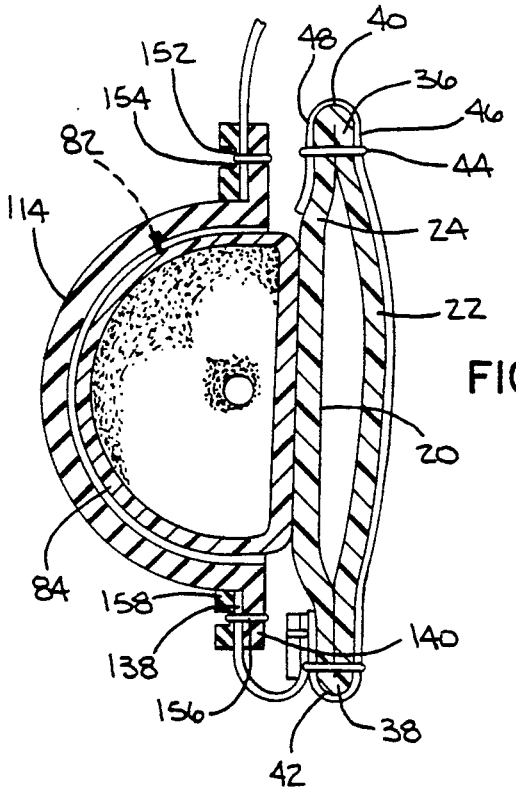
FIG. 9 is a cross-sectional view of the structure for directing a displaceable fluid into the bladder including the inventive cover therefor integrated into the crown and taken along line 9—9 of FIG. 4.
Figure 10:
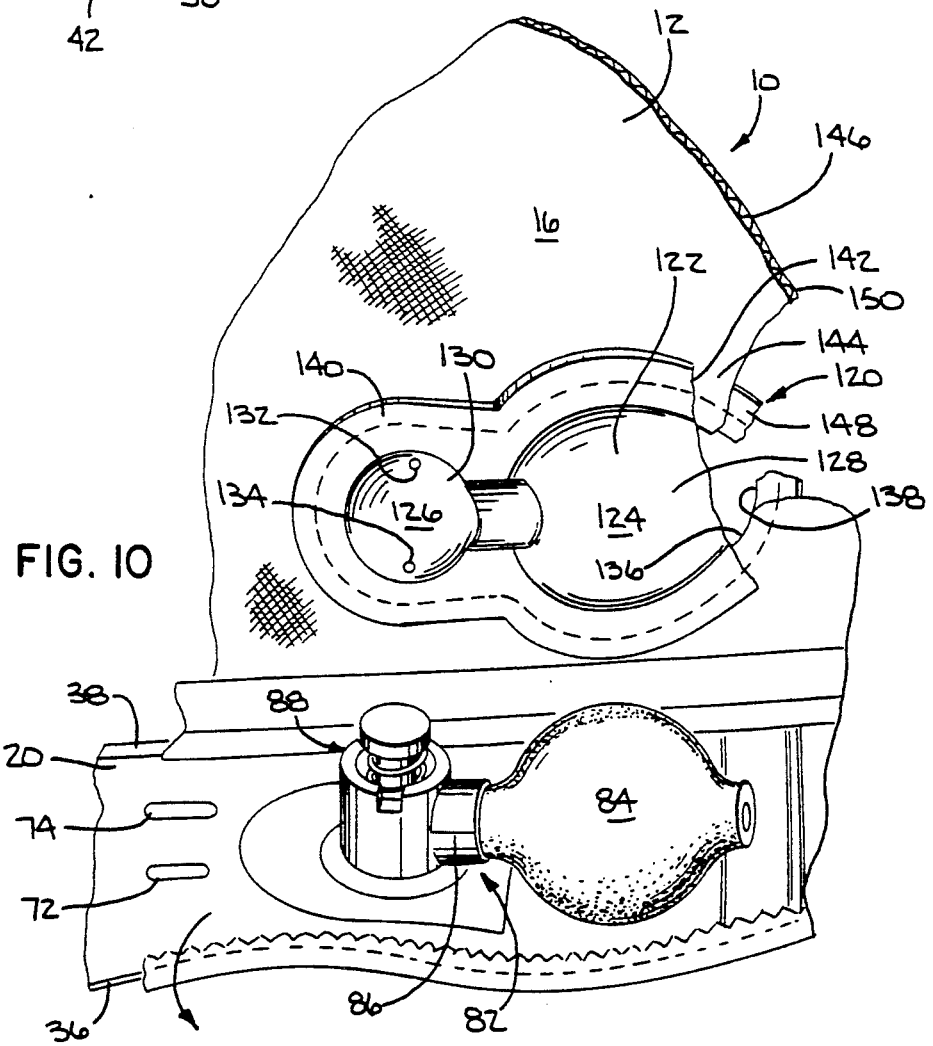
FIG. 10 is a fragmentary, perspective view of the structure for directing a displaceable fluid into, and allowing exhaustion of the displaceable fluid from, the bladder with the crown and inventive cover folded away therefrom.

By depressing the button 94, as shown in FIG. 7, the sealing face 108 is moved away from the shoulder 110 to thereby create an annular passageway 112 to allow air from the space 26 to communicate in the direction of arrows 113 out of the space 26.

To cover the means 82 and valve 88 and integrate the means 82 and valve 84 into the crown 12, a covering means is provided at 120. The covering means 120 includes a membrane 122 defining adjacent, cup-shaped receptacles 124, 126 for the bulb 84 and relief valve 88, respectively. The receptacles 124, 126 are configured and dimensioned so that with the sweat band 34 folded up into the crown 12, the bulb 84 nests in the receptacle 124 and the relief valve 88 nests in the receptacle 126.

With the headwear piece 10 on a wearer's head, the wearer can reach back and depress that portion 128 of the membrane 122 overlying the bulb 84 to thereby introduce air into the bladder space 26. Similarly, when it is desired to release air from the bladder space 26, a separate portion 130 of the membrane 122 is collapsed to thereby depress the actuating button 94 on the relief valve 88. Spaced ports 132, 134 through the membrane portion 126 allow the air in the bladder 20 to exhaust through the membrane 122 to externally of the headwear piece 10.

Preferably, the membrane 122 is made from rubber or plastic that is sufficiently resilient to readily allow actuation of the bulb 84 and relief valve 88. At the same time, the rubber or plastic making up the membrane 122 should have sufficient memory to maintain the membrane portions 128, 130 in their distended state.

The invention contemplates a novel connection of the membrane 122 to the crown 12. The fabric in the crown 12 is cut out to define an opening 136 in which the membrane 122 is mounted. The opening 136 is bounded by a fabric edge 138 which follows the general contour of the bulb 84 and valve 88. It should be understood that this particular shape is, however, merely a matter of design.

The membrane 122 has a rim 140, integrally formed as one piece therewith, which extends around the circumference of the opening 136 and defines a shoulder 142 to bear against the inside surface 144 of the crown wall 146.

A bead 148 is abutted to the outside surface 150 of the crown wall 146. The bead 148 has a shape conforming substantially to the rim 140. The bead 148 has a peripheral undercut 152 defining an outwardly facing wall 154.

A line of stitching 156 is directed through the wall 154, the fabric edge 138, and rim 140 to thereby capture and positively hold the fabric edge 138 between the rim 140 and bead 148. The arrangement of the rim 140 and bead 148, in addition to producing an aesthetically pleasing connection, reinforces the fabric edge 138 to positively hold the membrane 122 in place on the crown 12.

The above arrangement facilitates assembly of the membrane 122 to the crown 12. To effect assembly, the opening 136 is initially cut out of the crown 12 after which the membrane 122 is aligned with the opening 136 and directed inside out through the opening until the rim 140 abuts the crown surface 144. The membrane portions 128, 130 protrude externally of the crown 12 for ready access. The bead 148 is then placed around the protruding membrane portions 124, 126 and the stitching carried out to complete assembly.

The inside edge 158 of the bead 148 is preferably closely matched to the contour of the membrane portions 128, 130 to produce a neat connection and cover any frayed material that may be existent on the fabric edge 138. The undercut 152 also contributes to the neat aesthetic appearance of the covering means 120.

It should be understood that the covering means 120 could be used on other than a control for an inflatable bladder. The combination of the membrane 122, rim 140 and bead 148 can be similarly integrated into headwear using other types of size altering means.

It can be seen that the size of the cap 10 can be readily altered with the cap 10 in place on the head of a wearer. Once the cap 10 is put in place, the user need only actuate the bulb 84 at the back of the head. By simply pressing on the valve 88, the pressure in the bladder 20 can be reduced.

The above construction affords a highly durable cap 10 and one which can be economically manufactured.

The foregoing disclosure of specific embodiments is intended to be illustrative of the broad concepts comprehended by the invention.

I claim:

1. A headwear piece comprising:

a crown defining a first opening for reception of the head of a wearer;

an inflatable bladder;

means for mounting the inflatable bladder to the crown so that the inflatable bladder resides between the crown and a wearer's head in the crown opening;

means for selectively introducing a fluid to the bladder;

means for covering the fluid introducing means and allowing operation of the fluid introducing means from a location externally of the crown; and means for connecting the covering means to the crown, said connecting means comprising a rim on the covering means, a bead, and means for captively holding at least a part of at least one of the inflatable bladder and crown between the rim and bead.

2. The headwear piece according to claim 1 wherein said covering means includes a flexible membrane.

3. The headwear piece according to claim 2 wherein said membrane is made from one of plastic and rubber.

4. The headwear piece according to claim 2 wherein the flexible membrane has a preformed receptacle for the fluid introducing means.

5. The headwear piece according to claim 2 wherein the crown has a wall with an inside surface and an outside surface and a second opening therethrough and the rim defines a shoulder that bears on the inside crown surface with the covering means in an operative position on the crown.

6. The headwear piece according to claim 5 wherein the rim is formed as one piece with the membrane.

7. The headwear piece according to claim 6 wherein the rim extends continuously around the second crown opening.

8. The headwear piece according to claim 2 wherein the means for selectively introducing a fluid includes means for selectively exhausting fluid from the bladder and the bladder has a port to allow exhaustion of fluid from the bladder to externally of the crown.

9. A headwear piece comprising:

a crown defining a first opening for reception of the head of a wearer;

an inflatable bladder;

means for mounting the inflatable bladder to the crown so that the inflatable bladder resides between the crown and a wearer's head in the crown opening;

means for selectively introducing a fluid to the bladder;

means for covering the fluid introducing means and allowing operation of the fluid introducing means from a location externally of the crown; and means for connecting the covering means to the crown, wherein said covering means includes a flexible membrane, wherein the crown has a wall with an inside surface and an outside surface and a second opening therethrough and the connecting means includes a rim on the membrane defining a shoulder that bears on the inside crown surface with the covering means in an operative position on the crown, wherein the crown has an edge bounding the second crown opening and the connecting means includes a bead and means for captively holding the crown edge between the rim and bead.

10. The headwear piece according to claim 9 wherein the bead extends continuously around the second crown opening.

11. The headwear piece according to claim 10 wherein the bead and rim have a conforming shape.

12. The headwear piece according to claim 7 wherein the means for captively holding the crown edge includes stitching extending through the rim and bead.

13. The headwear piece according to claim 12 wherein the bead has an undercut through which the stitching is directed.

14. A headwear piece comprising:

a crown defining a first opening for reception of the head of a wearer;

means for selectively altering the size of the first opening;

means for covering at least a part of the size altering means; and means for connecting the covering means to the crown, wherein the crown has a second opening with an edge bounding the second crown opening and the connecting means includes a rim on the covering means, a bead, and means for captively holding the crown edge between the rim and bead.

15. The headwear piece according to claim 14 wherein the covering means includes a flexible membrane that is one of rubber and plastic and allows operation of the size altering means through the covering means from externally of the crown.

16. The headwear piece according to claim 14 wherein the flexible membrane has a preformed cup shape defining a receptacle for the size altering means.

17. The headwear piece according to claim 16 wherein the crown has a wall with an inside surface and an outside surface and a second opening therethrough and the rim is on the membrane and defines a shoulder that bears on the inside crown surface with the covering means in an operative position on the crown.

18. The headwear piece according to claim 17 wherein the rim is formed as one piece with the membrane and extends continuously around the second crown opening.

19. The headwear piece according to claim 17 wherein the crown has at least a portion that is flexible and the second opening extends through the flexible crown portion.

20. The headwear piece according to claim 17 wherein the headwear piece is a baseball-type cap.

21. A headwear piece comprising:

a crown defining a first opening for reception of the head of a wearer;

means for selectively altering the size of the first opening;

means for covering at least a part of the size altering means; and means for connecting the covering means to the crown, wherein the flexible membrane has a preformed cup shape defining a receptacle for the size altering means, wherein the crown has a wall with an inside surface and an outside surface and a second opening therethrough and the connecting means includes a rim on the membrane defining a shoulder that bears on the inside crown surface with the covering means in an operative position on the crown, wherein the rim is formed as one piece with the membrane and extends continuously around the second crown opening, wherein the crown has an edge bounding the second crown opening and the connecting means includes a bead extending continuously around the second crown opening and means for captively holding the crown edge between the rim and bead.

22. The headwear piece according to claim 21 wherein the means for captively holding the crown edge includes stitching extending through at least one of the rim and bead.

23. The headwear piece according to claim 22 wherein the bead has an undercut through which the stitching is directed.

24. The headwear piece according to claim 21 wherein the membrane projects externally of the crown to beyond the outside wall surface.

25. A headwear piece comprising:

a crown defining a first opening for reception of the head of a wearer;

means for defining a receptacle on the crown for at least a part of a means for altering the size of the first opening;

means for covering the at least part of a means for altering the size of the first opening; and means for connecting the covering means to the crown, said connecting means comprising a rim on the covering means, a bead, and means for captively holding a part of the crown between the rim and bead.

* * * * *